United States Patent [19]

Endo

[11] 4,300,285

[45] Nov. 17, 1981

[54] SAFETY RAZOR WITH BLADE CLEANING MEANS

[75] Inventor: Saijiro Endo, Seki, Japan

[73] Assignee: Kai Cutlery Center Co., Ltd., Gifu, Japan

[21] Appl. No.: 78,373

[22] Filed: Sep. 24, 1979

[30] Foreign Application Priority Data

Feb. 19, 1979 [JP] Japan ..... 54/18955

[51] Int. Cl.[3] ..... B26B 21/16

[52] U.S. Cl. ..... 30/41; 30/63; 30/47

[58] Field of Search ..... 30/41, 47, 61-63

[56] References Cited

U.S. PATENT DOCUMENTS

| | | | |
|---|---|---|---|
| 2,038,230 | 4/1936 | McWilliams | 30/61 |
| 2,069,920 | 2/1937 | Keighley | 30/61 |
| 3,263,328 | 8/1966 | Craig | 30/63 |
| 3,871,077 | 3/1975 | Nissen | 30/63 |
| 3,955,277 | 5/1976 | Pomfret | 30/47 |
| 4,037,321 | 7/1977 | Iten | 30/47 |
| 4,265,015 | 5/1981 | Asano | 30/47 X |

*Primary Examiner*—Gary L. Smith

*Attorney, Agent, or Firm*—Philip Rodman; Norbert P. Holler

[57] ABSTRACT

A safety razor having a retractable blade member. The safety razor has a platform integral with the handle portion of the razor and provided with a recess formed in the upper surface thereof, a blade support member movably received by the recess of the platform, a blade member provided with front cutting edge and secured to and supported by said blade support member so as to project forwardly from the latter, a cover member fixed to the platform and cooperating with the latter in movably holding therebetween the blade support member together with the blade member, and apparatus for moving the blade member between a first position where the cutting edge is fully retracted and disappears behind the cover member and a second position where the cutting edge is fully extended. The cover member and the platform cooperate with each other in defining therebetween an elongated opening through which the cutting edge is moved in and out as the blade supporting member is moved by the above-mentioned apparatus. When the blade supporting member is moved toward the first position, the shaved matters sticking to the cutting edge or its vicinity are scraped off by the peripheral edges of the elongated opening.

11 Claims, 17 Drawing Figures

SAFETY RAZOR WITH BLADE CLEANING MEANS

BACKGROUND OF THE INVENTION

The present invention relates to a safety razor and, more particularly, to a safety razor having a blade member which can be fully retracted into the head portion of the razor.

Hitherto, there have been proposed various types of safety razors having a blade member which is movable to enable the user to adjust the shaving geometry to suit his individual preferences and/or shaving requirements. For instance, the specification of U.S. Pat. No. 3,955,277 discloses a safety razor provided with an adjustable blade unit having a cap portion, guard portion and a blade member clamped therebetween, the blade unit further including a coupling structure for detachably connecting the unit to a cooperating handle, and an adjusting mechanism integral with the unit and operable independently of any cooperating handle for changing the relative positioning of the blade member and the guard portion to vary the shaving geometry of the blade unit.

This known safety razor, however, suffers from the following drawbacks.

Namely, since the blade member cannot be fully retracted into the stationary part of the razor, there will be a danger that the user is accidentally injured by the exposed cutting edge of the blade member during handling of the safety razor.

In addition, since this safety razor has no means for removing shaven material that sticks to the blade member at the cutting edge or in the vicinity thereof, the cutting power of the razor is diminished, thereby impairing the shaving effectiveness.

SUMMARY OF THE INVENTION

It is, therefore, an object of the invention to provide a safety razor having a blade element which can be fully retracted into the stationary part of the razor, when the razor is not used, to secure the user from the danger of accidental cutting by the cutting edge of the blade member.

It is another object of the invention to provide a safety razor having a fully retractable blade element, in which the shaved matters sticking to the blade element are scraped off and removed as the blade member is moved to the fully retracted position.

To these ends, according to the invention, there is provided a safety razor comprising: a platform integral with the handle portion of the safety razor; a cover member adapted to be fixed to the platform and to cooperate with the latter in movably holding therebetween a blade support member and a blade member supported by and projected forwardly from the latter, the blade member being provided at its front end with a cutting edge; and means for slidingly moving the blade support member together with the blade member relatively to the platform; wherein the cover member and the platform cooperate with each other in defining therebetween an elongated opening of a length and width substantially equal to the length and thickness of the blade element, whereby the blade element is moved between a first fully retracted position and a second fully extended position through the elongated opening and, when the blade member is moved toward the fully retracted position, the shaved material sticking to the cutting edge or at the vicinity thereof is scraped off and removed by the peripheral edges of the elongated bore.

The above and other objects, as well as other advantageous features of the invention will become more clear from the following description of the preferred embodiments taken in conjunction with the accompanying drawings.

Figure 8:
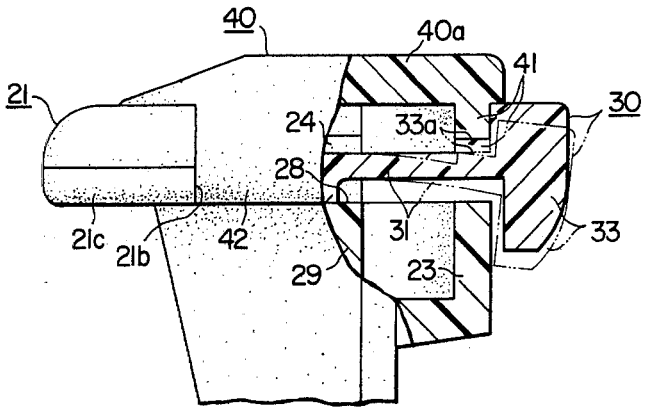
Figure 9:
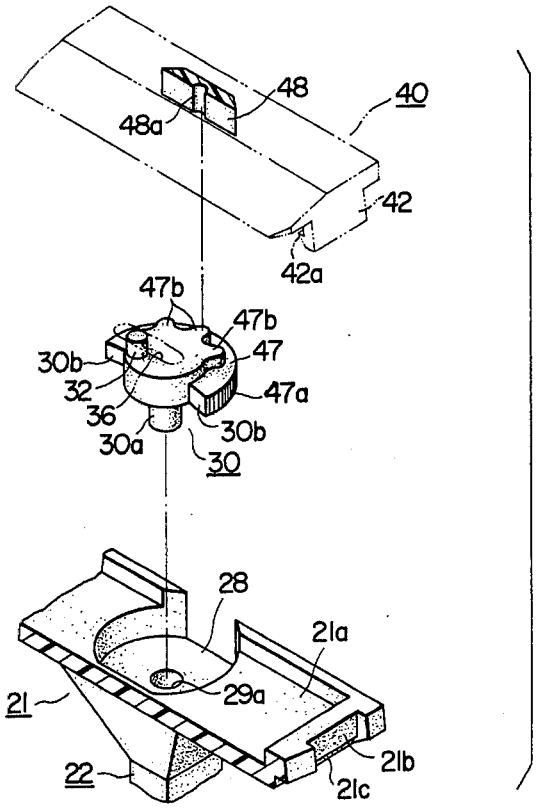
Figure 10:
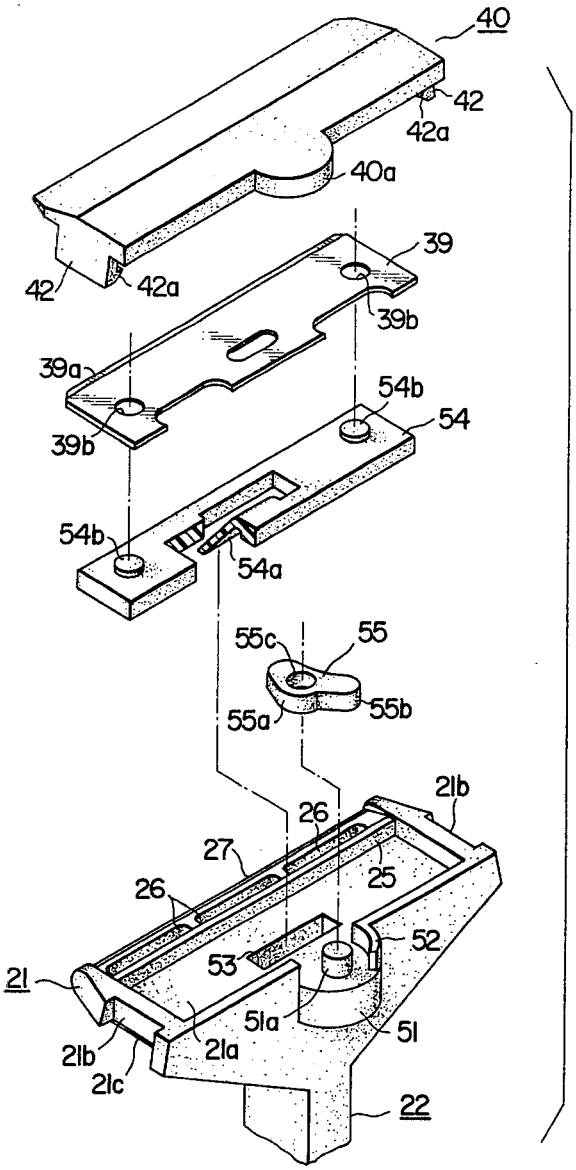
Figure 11:
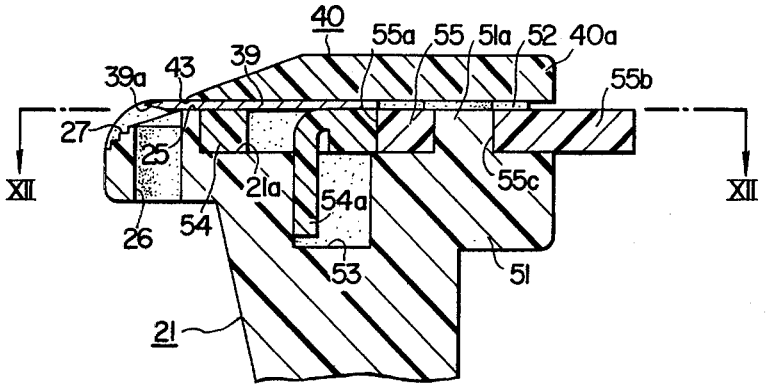
Figure 12:
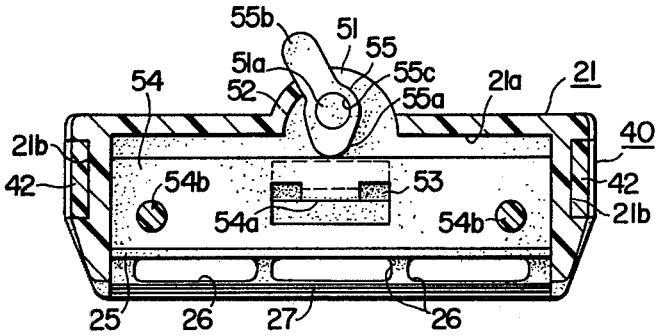
Figure 13:
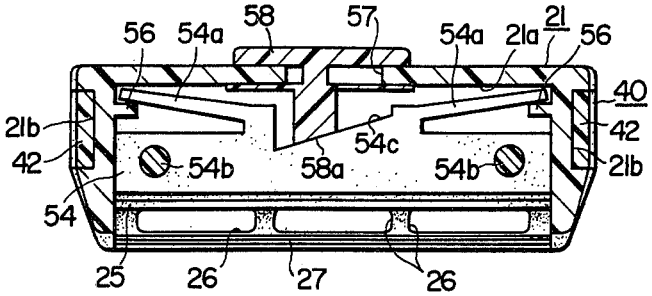

FIGS. *7a* to *7d* are plan views of different examples of a blade support member;

FIG. 8 is a partly-sectioned side elevational view of another modification of the first embodiments;

FIG. 9 is an exploded perspective view of a part of still another modification of the first embodiment;

FIG. 10 is an exploded perspective view of a safety razor which is constructed in accordance with a second embodiment of the invention;

FIG. 11 is an enlarged side elevational sectional view of the safety razor shown in FIG. 10;

FIG. 12 is a sectional view taken along the line XII—XII of FIG. 11;

FIG. 13 is a plan view of a modification of the second embodiment; and

Figure 14:
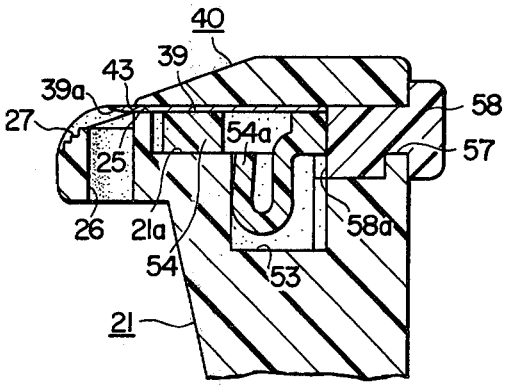

FIG. 14 is an enlarged side elevational sectional view of another modification of the second embodiment.

DESCRIPTION OF THE PREFERRED EMBODIMENTS

Referring first to FIGS. 1 to 5 showing an embodiment of the invention, a reference numeral 21 generally designates a platform formed integrally with the handle portion 22 of the safety razor. The platform 21 is provided at its top surface with a recess 21*a* adapted to movably receive a later-mentioned blade support member. The platform 21 is further provided at its both lateral sides with notches 21*b* and a rearwardly projecting curved back wall 23 on which marked are numerals 0, 1 and 2. Further, grooves 21*c* are formed at both side edges of the bottom surface of the platform 21. A pair of guide ridges 24 extending in the direction perpendicular to the longitudinal axis of the platform 21 are formed on the bottom of the recess 21*a* of the platform 21. One of these guide ridges has a rectangular cross-section, while the other has a trapezoidal cross-section.

A reference numeral 25 denotes a front wall defining the front end of the recess 21*a*. The front wall 25 is recessed to a depth which is equal to the thickness of a later-mentioned blade member so as to provide an opening through which the blade member is moved into and out of the razor head. Three elongated apertures 26 are formed on the portion of the platform 21 projected ahead of the front wall 25. These elongated apertures 26 are provided for allowing the shaved material, which have been removed from the blade member in a later-described manner, to drop therethrough. A reference numeral 27 denotes a laterally extending ridge formed on the front edge of the platform and having a saw-tooth-like cross-section. At the central rear part of the recess 21*a*, is formed a guide recess 28. A cylindrical supporting column 29 having a supporting bore 29*a* is formed to stand up from the central part of the bottom of the guide recess 28.

A manual operation member 30 is rotatably received by the guide recess 28 of the platform 21. The manual operation member 30 is provided with a projection or a boss 30*a* which extends downwardly from the lower surface thereof so as to be received by the supporting bore 29*a*. A resilient web 31 is projected rearwardly from the manual operation member. Also, an eccentric pin 32 is formed on the upper surface of the manual operation member 30, at a certain eccentricity from the center of the boss 30*a*. Further, sector-shaped stoppers 30*b* are formed to project outwardly from both lateral ends of the manual operation member 30. A manipulation knob 33 is formed on the end of the resilient web 31. The knob 33 is provided on its front surface with a clicking pawl 33*a* of a triangular cross-section. A pointing ridge 33*b* formed on the rear surface of the knob 33 is adapted to point one of the aforementioned numerals marked on the curved wall 23, as the knob 33 is swung around the axis of the supporting bore 29*a*, i.e. the axis of the boss 29.

As stated before, a blade support member 34 is received by the recess 21*a* for free movement in the direction perpendicular to the longitudinal axis of the platform 21. The lower surface of the support member 34 is provided with a pair of grooves 35, one of which having a rectangular cross-section while the other having a trapezoidal cross-section so as to slidingly receive, respectively, the aforementioned guide ridges 24 having rectangular and trapezoidal cross-sections. The blade support member 34 is provided at its central portion with an elongated through bore 36 adapted for slidably receiving the aforementioned eccentric pin 32 of the manual operation member 30. Also, a pair of bosses 34*a* are formed to project upwardly from both lateral end portions of the top surface of the blade support member 34. Each of the front and rear sides of the blade support member 34 is notched at its both lateral ends as at 37 so that resilient tabs 38 are formed at both lateral ends of each of the front and rear edges of the blade support member 34. Each resilient tab 37 is provided with a projection 38*a* projecting laterally outwardly therefrom and having a semicircular cross-section. The projection 38*a* is adapted to be resiliently pressed against the corresponding side wall of the recess 21*a* by the resiliency of the resilient tab 38.

A blade member 39 provided at its front end with a cutting edge 39*a* is secured to the blade support member 34 to project forwardly from the latter. The blade member 39 is provided at its both lateral end portions with bores 39*b* for disengageably receiving the aforementioned bosses 34*a* of the blade support member 34.

A cover member 40 is adapted to be fixed to the platform 21 to cooperate with the latter, in holding therebetween the manual operation member 30, blade support member 34, and the blade member 39. The cover plate 40 is provided at the central portion of the rear edge thereof with a semicircular projection 40*a* from which extended downwardly is a semi-cylindrical curved wall 41. The semi-cylindrical curved wall 41 has click dents 41*a* formed therein. These dents 41*a* have a triangular cross-section corresponding to the triangular cross-section of the clicking pawl 33*a* of the knob 33, so as to be selectively engaged by the pawl 33*a*.

A pair of legs 42 are formed to extend downwardly from both lateral ends of the cover member 40 so as to be engaged by the notches 21*b* formed at both sides of the platform 21. Inwardly directed claws 42*a* are formed at lower ends of respective legs 42 and are adapted to detachably engage the grooves 21*c* of the platform 21 when the legs are engaged by the notches 21*b*. The front edge of the cover member 40 cooperates the upper edge of the aforementioned front wall 25 of the platform 21 in defining therebetween an elongated laterally extending opening 43 through which the blade member 39 is moved into and out of the space under the cover member 40.

Figure 1:
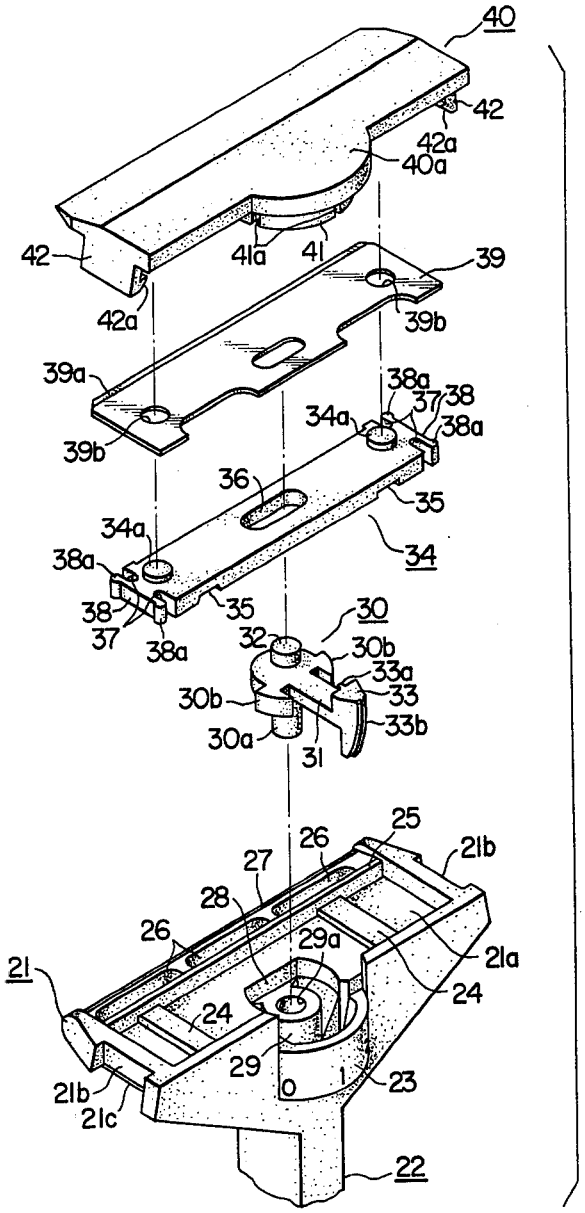
FIG. 1 is an exploded perspective view of a safety razor which is constructed in accordance with a first embodiment of the invention.
Figure 2:
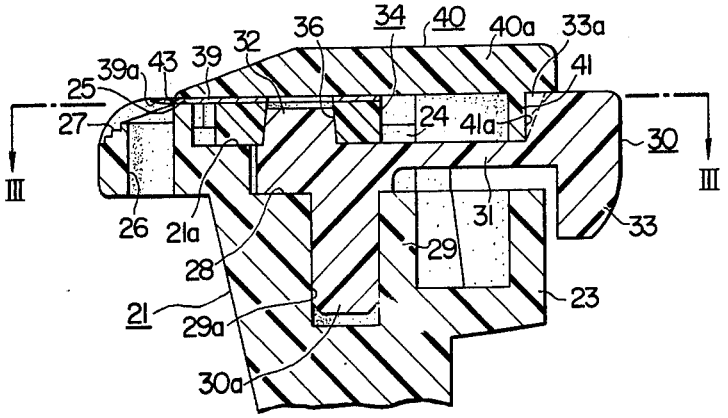
FIG. 2 is an enlarged sectional view of the safety razor as shown in FIG. 1, with the cutting edge of the blade member thereof emerging through an opening.
Figure 3:
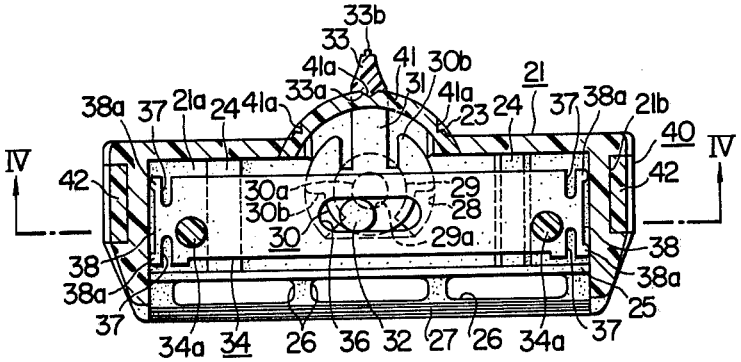
FIG. 3 is a sectional view taken along the line III—III of FIG. 2.
Figure 4:
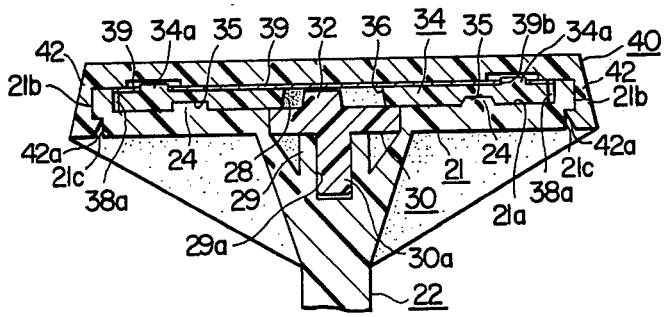
FIG. 4 is a sectional view taken along the line IV—IV of FIG. 3.

Hereinafter, the description will be made as to how to use the safety razor of the first embodiment having the described construction. The manual operation member 30 is rotatable, as stated before, around the axis of the boss 30*a* thereof, between a first position where the right stopper 30*b* is contacted by the front wall of the guide recess 28 of the platform 21 and a second position where the left stopper 30*b* is stopped by the same front wall, as shown in FIG. 3. This angular movement of the operation member 30 from the first position to the second position is effected by a manual rotation of the knob 33 from a first position where the clicking pawl 33*a* is received by the right click dent 41*a* to a second position where the clicking pawl 33*a* is received by the left clicking dent 41*a*, via an intermediate position where the clicking pawl 33*a* is engaged by the central click dent 41*a*. Clearly, the pointing ridge 33*b* of the knob 33 points the numerals 0, 1 and 2, when the knob 33 takes the first, intermediate and the second positions, respectively. As the manual operation member 30 is rotated from the first to the second position, the eccentric pin 32 drives the blade support member 34 from a first position located at a rear portion of the recess 21*a* of the platform 21 to a second position located at a front portion of the same via an intermediate position, making a sliding contact of the wall of the elongated bore 36 of the blade support member 34. In consequence, the cutting edge 39*a* of the blade member 39 which is moved unitarily with the blade support member 34 is moved from a fully retracted position under the cover of the cover member to a fully projected position via an intermediate position.

The movement of the blade support member 34 is smoothed and stabilized due to the sliding engagement of the grooves 35 of the blade support member 34 with the guide ridges 24 of the base plate and also to the resilient sliding contact of the resilient tabs 38 of the blade support member 34 with the left and right walls of the recess 21*a* of the platform 21, so that the blade support member together with the blade member secured thereto makes a translational movement.

Figure 5:
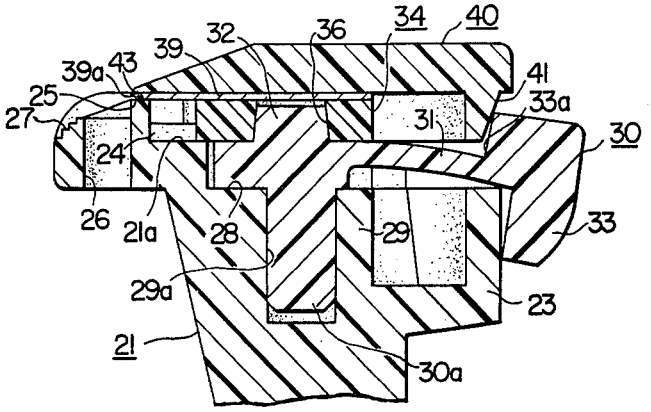
FIG. 5 is an enlarged sectional view of the safety razor as shown in FIG. 1, with the cutting edge fully retracted into the opening.

The resilient web 31 of the manual operation member 30 is deflected resiliently as shown in FIG. 5, when the clicking pawl 33*a* of the knob 33 takes a position out of the click dents 41*a*. The resultant resilient resetting force of the resilient web 31 ensures a safe engagement of the pawl 33*a* with the dent 41*a*. For a shaving purpose, the manual operation member 30 is rotated through a manipulation of the knob 33 to a position where the pointing ridge 33*b* of the knob 33 points the numeral 1 or 2 of the curved wall 23 of the platform 21, so that the cutting edge 39*a* of the blade member 39 emerges out of the opening 43. The extent of projection of the cutting edge 39*a* is selected as desired in accordance with the thickness of the beard of the user or the user's preference. After the shaving, a residue of shaven material accumulates at or sticks to the cutting edge 39*a* or its vicinity.

According to the invention, the accumulated shaven material is effectively scraped and removed from the blade member, as will be understood from the following description. To this end, the knob 33 is rotated until the pointing ridge comes to point the numeral 0 (zero) on the curved wall 23. In consequence, the blade member 39 is fully retracted and the cutting edge 39*a* disappears through the opening 43 so as to be completely covered and protected by the cover member 40. During this movement of the blade member 39, the shaven material that accumulates or sticks to the cutting edge or its vicinity is effectively scraped by the peripheral edges of the opening 43 and removed from the blade member 39. The shaven material thus separated from the blade member 39 is then washed and carried away through the elongated apertures 26 formed in front of the opening 43, as the razor is rinsed. It is also to be understood that, since the cutting edge is fully retracted into the space behind the cover member, the user is protected from the danger of accidental injury by the cutting edge.

Figure 6:
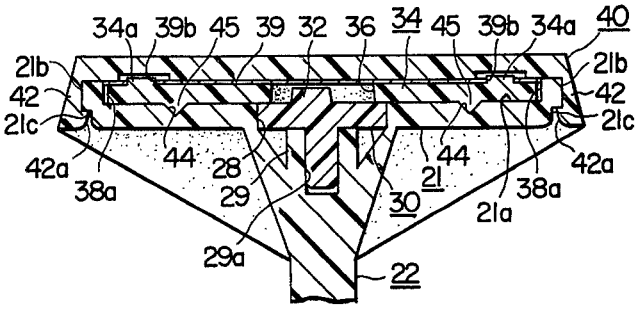
FIG. 6 is a front elevational view of a modification of the safety razor of the first embodiment.
Figure 7A:
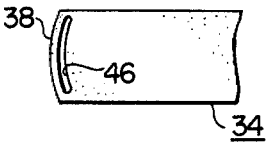
Figure 7C:
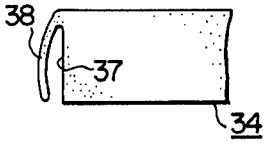
Figure 7B:
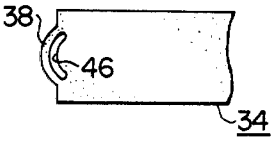
Figure 7D:
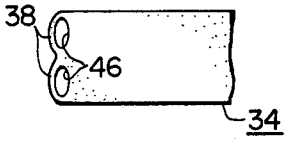

FIGS. 6 to 9 show modifications of the first embodiment. In the modification as shown in FIG. 6, the guide ridges 24 of the platform 21 of the first embodiment are substituted by guide grooves 44 having a triangular cross-section, while the grooves 35 of the blade support member 34 are substituted by ridges 45 having a triangular cross-section and adapted to fit in the triangular cross-sectioned guide grooves 44. The triangular cross-section of the guide ridges 24, grooves 35, guide grooves 44 and the ridges 45 are not exclusive. For instance, they can have semicircular cross-sections.

FIGS. 7*a* to 7*d* show different examples of the resilient tabs of the blade support member 34. More specifically, in the modification shown in FIG. 7*a*, an arcuate elongated aperture is formed at each end of the blade support member 34, in place of the aforementioned notches 37, so as to form an arcuate resilient tab 38. Similarly, in the modification shown in FIG. 7*b*, the blade support member 34 is provided at its each end with a semicircular aperture 46 which provides a semicircular resilient tab 38. In case of the modification shown in FIG. 7*c*, each end of the blade support member 34 is notched only at one side thereof as at 37, so that an elongated resilient tab 38 is formed. Finally, in case of the modification shown in FIG. 7*d*, two elongated apertures 46 are formed at each side of the blade support member 34 so as to provide resilient tabs 38 having a wave-like form. Although the resilient tab 38 is provided in each case on the blade support member 34, this is not exclusive and it is possible to provide the resilient tab on the inner surface of the side walls of the platform 21, or on both of the blade support member 34 and the platform 21.

FIG. 8 shows another modification in which notch or groove 41*a* is formed in the lower surface of the curved wall 41 of the cover plate 40, while the clicking pawl 33*a* on the front surface of the knob 33 is substituted by a clicking protrusion 31*a* formed on the upper surface of the resilient web 31.

Although the curved wall 41 has been described to be formed integrally with the cover plate 40, it is possible to form this curved wall 41 unitarily with the platform 21.

FIG. 9 shows still another modification in which a manipulation disc 47 is used in place of the combination of the resilient web 31*a* and the manipulation knob 33. The manipulation disc 47 is formed unitarily with the stoppers 30*b* and has a portion exposed to the outside of the platform 21, the peripheral surface of that portion of the manipulation disc 47 being milled for an easy manipulation by a finger. On the upper surface of the manipulation disc 47, formed are three projections 47*b* extending rearwardly. Also, the curved wall 41 of the cover plate is substituted by a wall 48 which has a vertical groove 48*a* for receiving selected one of the projections 47*b*. In use, the manipulation disc 47 is manually operated to bring the projections 47*b* into and out of engagement with the vertical groove 48*a*. The resiliency which is provided in the foregoing modifications by the resilient web 31 is presented in this case by the wall 48.

In the described embodiment and modifications the manual operation member 30 makes a movement in a stepped or clicking manner with respect to the platform 21 or the cover plate 40, such that the cutting edge 39*a* of the blade member 39 comes out through the opening in a stepped manner via the intermediate position. The clicking at this intermediate position, however, is not essential and can be eliminated. In such a case, the blade member can be moved substantially smoothly from the fully retracted position to the fully extended position.

Hereinafter, a second embodiment of the invention will be described with reference to FIGS. 10 to 12. This second embodiment differs from the first embodiment only in the following points.

A reference numeral 51 denotes a supporting projection formed at the central rear part of the platform 21. The supporting projection 51 has a columnar support pin 51*a* which extends upright from the top surface thereof, and a stopper wall formed to extend upward from one peripheral edge thereof so as to surround the support pin 51*a*. A reference numeral 53 denote a rectangular retaining bore formed in the center of the bottom surface of the recess 21*a* of the platform 21.

A rectangular blade support member 54 is received by the recess 21*a* of the platform 21 for free movement in the back and forth direction and is biased rearwardly. At the center of the blade support member 54, formed is a rectangular through bore. At the rear wall of the through bore, a resilient tab 54*a* is formed which is bent forwardly and downwardly substantially in the form of L so as to be resiliently engaged and retained by the front wall of the retaining bore 53. As in the case of the first embodiment, the blade support member 54 is provided at both sides of upper surface thereof with projections 54*b* for fixing the blade member 39.

A reference numeral 55 denotes an operation member rotatably supported by the supporting pin 51*a* of the aforementioned supporting projection 51. At the periphery of the operation member 55, a cam surface 55*a* is formed which contacts the rear surface of the blade support member 54. The rear part of the operation member 55 constitutes a manipulation knob 55*b*. A bore 55*c* for rotatably receiving the supporting pin 51*a* is formed at the center of the operation member 55.

In operation, since the blade support member 54 is always biased rearwardly by the resilient tab 54*a*, the rear surface of the blade support member 54 is always kept in pressure contact with the cam surface of the operation member 55.

As the operation member 55 is rotated in this state by a manual force, the blade support member 54 is slided back and forth by the action of the cam surface 55*a*, which in turn causes a back and forth sliding movement of the blade member 39. As in the case of the first embodiment, the shaven material sticking to the cutting edge 39*a* of the blade member 39 is scraped and removed by the peripheral edges of the opening 43, as the blade member 39 is moved toward the retracted position.

FIG. 13 shows a modification of the second embodiment. In this modification, a pair of projections 56 are formed on rear parts of opposing surfaces of the side walls defining the recess 21*a*. Also, a slide guide bore 57 is formed at the center of the rear wall of the platform 21. An operation member 58 having a tapered front end surface 58*a* is received by the slide guide bore 57 for free sliding movement in the lateral directions.

In this modification, the resilient tabs 54*a* of the blade support member 54 are formed at both sides of the rear part of the blade support member 54 so that they may resiliently contact at their front end surfaces the aforementioned retaining projections thereby to bias the blade support member rearwardly. The rear surface of the blade support member 54 is tapered to constitute a sliding surface 54*c* adapted to be slidingly contacted by the tapered surface 58*a* of the aforementioned operation member 58.

Since the blade support member 54 is always resiliently biased rearwardly by the resilient tabs 54*a*, it is possible to move the blade support member back and forth by changing the position of contact of the tapered surface 58*a* of the operation member 58 with the sliding surface 54*c*.

FIG. 14 shows another modification in which the resilient tabs 54*a* of the blade supporting member 54 of the second embodiment are modified to have a substantially U-like form and are associated with the operation member 58 as shown in FIG. 13.

As will be apparent from the foregoing description, the safety razor of the invention offers the following advantages.

Firstly, it is possible to obtain the desired shaving geometry, by changing the projection length of the cutting edge, in accordance with the user's preferences.

Secondly, it is possible to remove the shaved matters sticking to the cutting blade automatically by moving the latter to the fully retracted position, so that the cutting performance of the cutting edge can be preserved for a longer period of time.

Thirdly, since the cutting edge can be fully retracted when the razor is not used, the user is protected from the danger of an accidental injury by the cutting edge during handling of the safety razor.

Although the invention has been described through its preferred forms, it is to be noted that all features of the described embodiments are not essential nor exclusive. For instance, the invention can equally be applied to other types of safety razor than the described T-shaped razor in which the platform is formed integrally with the handle or stem.

Other changes and further modifications are possible without departing from the scope of the invention which is limited solely by the appended claims.

What is claimed is:

1. A safety razor comprising, a platform member including a first blade wiping portion, a handle joined to said platform member, cutting means supported on said platform member and including a blade member having a longitudinal cutting edge, said cutting means being relatively movable with respect to said platform member to move said longitudinal cutting edge from a protracted shaving position to a retracted non-shaving position, and vice versa, said cutting means being supported on said platform member such that said blade member is in contact with said first wiping portion in the vicinity of said longitudinal cutting edge during movement of said cutting means, a cover member disposed over said cutting means to permit exposure of the longitudinal cutting edge of said blade member while otherwise confining said cutting means between said platform member and said cover member, said cover member including means for connecting said cover member to said platform member, and means for moving said cutting means and said longitudinal cutting edge from said protracted position wherein the longitudinal cutting edge is extended from between the cover member and the platform member for use during shaving, to said retracted position wherein the longitudinal cutting edge is not extended for shaving use, thereby enabling said first wiping portion to wipe said blade surface in the vicinity of said longitudinal cutting edge for removal of shaven material and wherein said longitudinal cutting edge is entirely disposed between said first blade wiping portion and said cover member so as to render said longitudinal cutting edge incapable of cutting when said moving means moves said longitudinal cutting edge to said retracted position.

2. A safety razor as claimed in claim 1 wherein said first blade wiping portion comprises an elongated surface projecting against said blade member.

3. A safety razor as claimed in claim 1, said blade member having a first surface and being in contact with said first wiping portion at said first surface, said blade member further including a second surface substantially parallel to said first surface, and wherein said cover member has a second blade wiping portion in contact with said blade member at said second surface at the vicinity of said longitudinal cutting edge such that said blade member is sandwiched between said first and second wiping portions.

4. A safety razor as claimed in claim 3 wherein said longitudinal cutting edge is entirely disposed between said first and second blade wiping portions so as to render said longitudinal cutting edge incapable of cutting when said moving means moves said longitudinal cutting edge to said retracted position.

5. A safety razor as claimed in claim 1 wherein said means for moving said cutting means comprise a manually movable operation member supported on said platform for engagement with said cutting means such that movement of said operation member in a predetermined manner causes movement of said cutting means and said longitudinal cutting edge from said protracted position to said retracted position.

6. A safety razor as claimed in claim 5 wherein said cutting means includes a slot and said operation member includes a cam member engageable in said slot such that movement of said cam in said slot causes movement of said cutting means.

7. A safety razor as claimed in claim 6 wherein said operation member is pivotable about a fixed axis and said cam member is eccentric to said fixed axis to cause movement of said cam member in said slot when said operation member is pivoted about said fixed axis.

8. A safety razor as claimed in claim 5 wherein said operation member includes a cam surface and said cutting means includes a cam follower portion engageable by said cam surface such that movement of said cam surface against said cam follower portion causes movement of said cutting means.

9. A safety razor as claimed in claim 8 wherein said operation member is linearly slideable with respect to said platform member to cause movement of said cutting means.

10. A safety razor as claimed in claim 8 wherein said operation member is rotatable about a fixed axis to cause movement of said cutting means.

11. A safety razor as claimed in claim 1 further including detent means provided on said platform member and said means for moving said cutting means, to detent said moving means in first and second positions respectively corresponding to the protracted and retracted positions of said longitudinal cutting edge.

* * * * *